United States Patent [19]

Tringali et al.

[11] 4,197,837

[45] Apr. 15, 1980

[54] INFLATABLE-DEFLATABLE PAD AND AIR CONTROL SYSTEM THEREFOR

[75] Inventors: Richard C. Tringali, Manitowoc; William D. Christoffel, Two Rivers; Paul R. Zeman, Manitowoc, all of Wis.

[73] Assignee: American Hospital Supply Corporation, Evanston, Ill.

[21] Appl. No.: 3,502

[22] Filed: Jan. 15, 1979

Related U.S. Application Data

[63] Continuation of Ser. No. 839,371, Oct. 4, 1977, abandoned.

[51] Int. Cl.[2] ..... A61H 1/00

[52] U.S. Cl. ..... 128/33; 128/40; 137/565.1

[58] Field of Search ..... 128/33, 24 R, 24.1, 128/24.2, 38-40, 64; 137/565, 565.1

[56] References Cited

U.S. PATENT DOCUMENTS

| | | | |
|---|---|---|---|
| 1,772,310 | 8/1930 | Hart | 128/33 |
| 2,998,817 | 9/1961 | Armstrong | 128/40 UX |
| 3,192,951 | 7/1965 | Weiss | 137/565 |
| 3,394,415 | 7/1968 | Parker | 128/33 X |
| 3,446,203 | 5/1969 | Murray | 128/24.2 |
| 3,462,778 | 8/1969 | Whitney | 128/33 X |
| 3,467,081 | 9/1969 | Glass | 128/33 |
| 3,757,366 | 9/1973 | Sacher | 128/33 X |
| 3,908,642 | 9/1975 | Vinmont | 128/40 |
| 3,920,006 | 11/1975 | Rapidus | 128/24.1 |

*Primary Examiner*—Lawrence W. Trapp
*Attorney, Agent, or Firm*—Tilton, Fallon, Lungmus & Chestnut

[57] ABSTRACT

An inflatable pad combined with an air control system for producing periodic inflation and deflation of that pad. The pad is elongated and has at least two separate passages extending from one end portion of the pad to the other, such passages also having interlaced transverse portions extending in directions across the pad. Each passage has a pair of terminal openings, one at each end of the pad, for the flow of air under pressure, such flow being controlled by a valve which not only alternates in directing air to inflate one passage and then the other, but also alternates the direction of inflation so that each passage is inflated alternately from its opposite ends. In one embodiment, the valve operates to positively exhaust one passage while the other is undergoing inflation, the exhaust air being recirculated and utilized by the compressor which serves as the source of pressurized air. Conservation and protection against overinflation may also be achieved by modifying the valve assembly to recirculate excess air, that is, air at a pressure greater than can be effectively or safely utilized by the pad. In all forms, the pad is provided with perforations on one side thereof which form bleed ports for the leakage of pressurized air from the passages, such leakage not only contributing to controlled deflation of the passages but also resulting in cooling air being directed against the limb or body of a person in close proximity to the pad.

42 Claims, 13 Drawing Figures

VALVE ROTATION
VALVE ROTATION

INFLATABLE-DEFLATABLE PAD AND AIR CONTROL SYSTEM THEREFOR

This application is a continuation of abandoned copending application Ser. No. 839,371, filed Oct. 4, 1977.

BACKGROUND

U.S. Pat. No. 3,653,083 discloses an inflatable bed pad with passages which expand and collapse as they are inflated and deflated. Perforations which are formed in the top wall of the pad and which communicate with the passages allow air to escape upwardly through a foam cushion or sheet extending over the pad. Inflating air is introduced at one end of each passage by means of an air pressure line connected to the pad and a valve controls the flow of air so that one passage is inflated as the other is allowed to deflate, such deflation occurring because of the upward flow of air through the perforations of the passage to which the air supply is temporarily interrupted. As a result, such alternating inflation and deflation of the passages produces a "rippling effect" which stimulates peripheral circulation and relieves localization of pressure for a patient lying upon the pad and its foam cushion. Also, because air escapes from the perforations and passes upwardly through the foam cushion, a gentle drying effect is produced which prevents or reduces skin maceration caused by trapped perspiration. The total effects are an increase in patient comfort and a substantial elimination in the formation of decubitus ulcers previously experienced by bedridden patients.

Other U.S. Pat. Nos. reflecting the state of the prior art are 2,998,817 (an inflatable mattress having two arrangements of transverse cells, each of the cells being simultaneously inflated (or deflated) from its opposite ends), 95,848 (an air bed which, in one embodiment has one or more tubes supplied with air from one end, closed at the opposite end, and provided with perforations to discharge air for cooling and ventilating purposes), 3,486,177 (vertilated cushion), 3,266,064 (ventilated mattress and box spring combination), 3,394,415 (alternating pressure pad), 3,199,124 (alternating pressure mattress), 1,772,310 (variable pressure mattress), 2,345,073 (an apparatus including a distribution valve for controlling the air flow for therapeutic devices), 3,908,642 (a distributor and associated elements for directing pulsating air into and out of casts), 3,919,730 (inflatable body support), 3,446,203 (pneumatic cushion), 3,462,778 (inflatable mattress), and 3,467,081 (inflatable mattress).

SUMMARY

One aspect of this invention lies in providing an inflatable pad system in which the direction of the ripples or waves is cyclically reversed, thereby tending to produce a more effective alternation of pressure points, more complete ventilation, and a more effective massaging action than prior systems. Also, in certain forms of the invention disclosed herein, greater operating efficiency is achieved because excess pressurized air is recirculated. Such automatic recirculation additionally performs a safety function because it prevents overinflation of the chambers or passages of the pad.

Positive deflation of each passage, alternately from opposite ends of that passage, is achieved in one embodiment of this invention. Thus, in such embodiment successive deflations as well as successive inflations of each passage or chamber take place alternately from opposite ends of that passage. In all forms, the passages are provided with perforations in the top wall of the pad which result in the bleeding or leaking of air towards the patient, thereby cooling, aerating and drying the patient's skin as well as improving circulation and alternating the points of pressure. The air discharged from the perforations is directed through a foam pad or cushion as generally disclosed in aforementioned U.S. Pat. No. 3,653,083.

In brief, the system includes a pad having a resilient top wall and a bottom wall joined together to form at least two separate passages which extend substantially the full length of the pad and which have interlaced tubular portions extending transversely of that pad. Each passage is connected at its opposite ends to a pair of conduits which lead to a suitable control valve. Therefore, if two such passages are provided, a total of four conduits would be used to operatively connect the control valve assembly and the pad. The control valve assembly is also connected to a source of air (or other suitable fluid) under pressure—specifically, a compressor or pump—so that as the valve operates air under pressure is directed successively into each of the four conduits, thereby inflating each of the passages from one end and then later from the opposite end. Deflation of each passage occurs because of the escape of air through the perforations in the top wall of the pad but, as already indicated, such deflation may be augmented by positive evacuation of one passage as another is being inflated. In that case, the control valve assembly is modified to utilize each of the conduits at different times as an air evacuation line as well as an air supply line, the control valve assembly being connected to the intake of the compressor to accomplish such positive evacuation.

Instead of, or in addition to, positive evacuation, the control valve assembly may be adapted to recirculate excess pressurized air, that is, air which is in excess of what is needed to inflate each of the passages or chambers. In such modifications or embodiments, the control valve assembly performs a regulator function so that when the inflation pressure reaches a preselected level the valve assembly will automatically divert and recirculate additional air from the compressor beyond what is required to maintain the air pressure in the passage at the preselected level. The control valve assembly may also include flow restricting means for selectively controlling the flow of air evacuated from the pad and returning to the compressor, thereby regulating the extent and rate of evacuation of each chamber or tube.

The control valve assembly essentially comprises a valve body having an inlet for air under pressure and a plurality of openings for directing air to (and, in some instances, from) the conduits leading to the inflatable pad; a rotor for directing the flow of air through the valve body in accordance with the position of the rotor; and a motor for turning the rotor relative to the valve body. The valve body may also be equipped with an outlet for the recirculation of air back to the compressor and an annular groove which communicates with that outlet and which may be placed in communication with each of the openings leading to the conduits as the rotor turns. By spring-loading the rotor with a compression spring having selected compression force characteristics, the rotor may cooperate with the valve body to serve as a regulator for limiting the pressure to which the passages of the pad are inflated, the annular groove serving to collect excess air not used by the pad and returning that air to the compressor.

Other structural features, advantages, and objects of the invention will become apparent from the specification and drawings.

DRAWINGS

DETAILED DESCRIPTION

Figure 2:
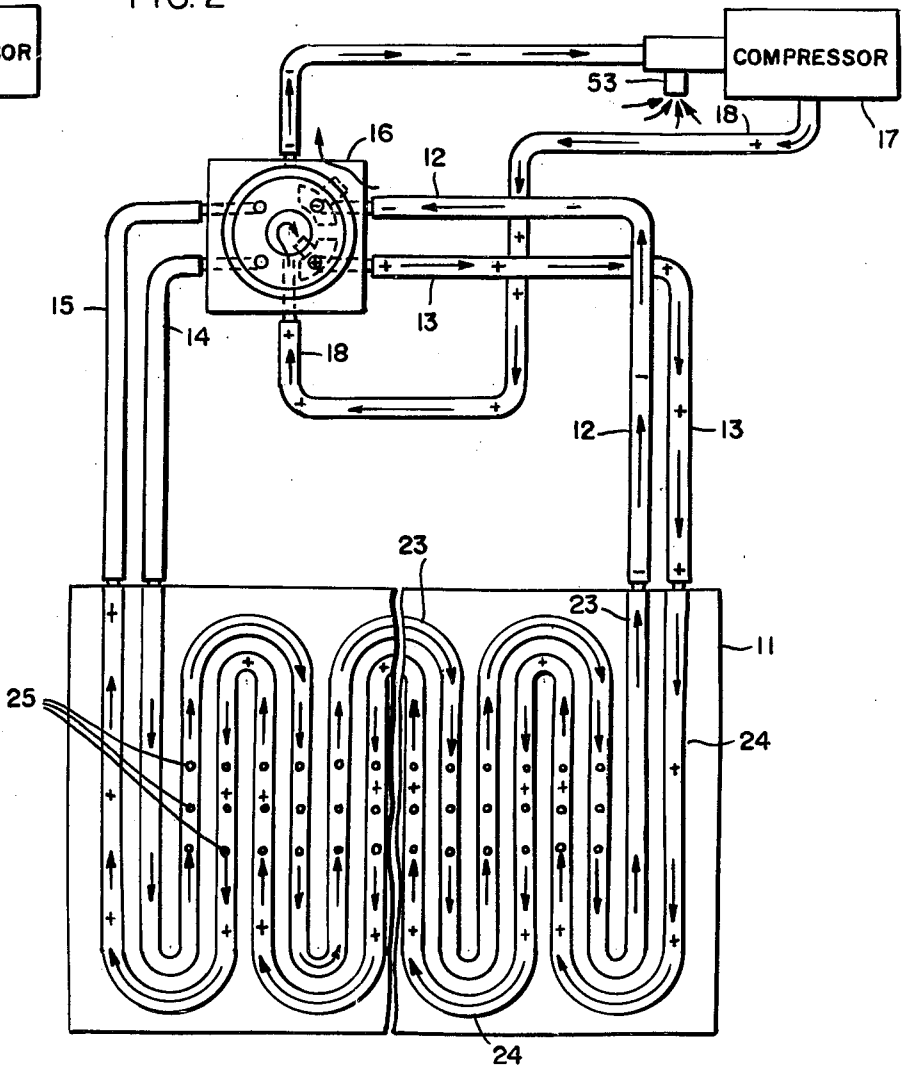
FIG. 2 is a schematic view similar to FIG. 1 but showing the control valve in a second position of adjustment.

Referring to FIGS. 1–9, the numeral 10 generally designates a system or assembly comprising an inflatable pad 11, conduits 12–15, and a source of pressurized air (or other fluid) in the form of compressor 17. In the embodiment illustrated, the compressor is connected to the control valve assembly by means of a supply conduit 18 and an exhaust conduit 19.

Figure 1:
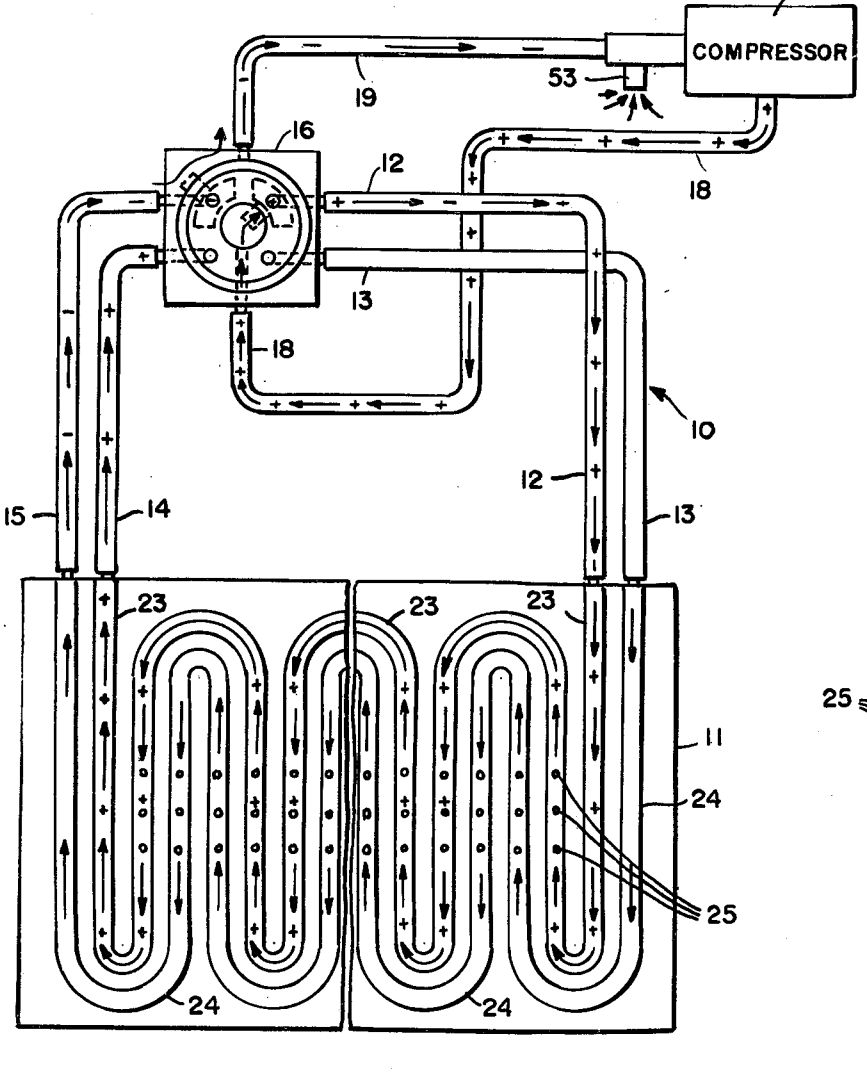
FIG. 1 is a somewhat schematic view of an inflatable pad and air control system embodying the present invention, the system being illustrated with the control valve in one position of adjustment.
Figures 3, 4, 5, 6, 7, 8:
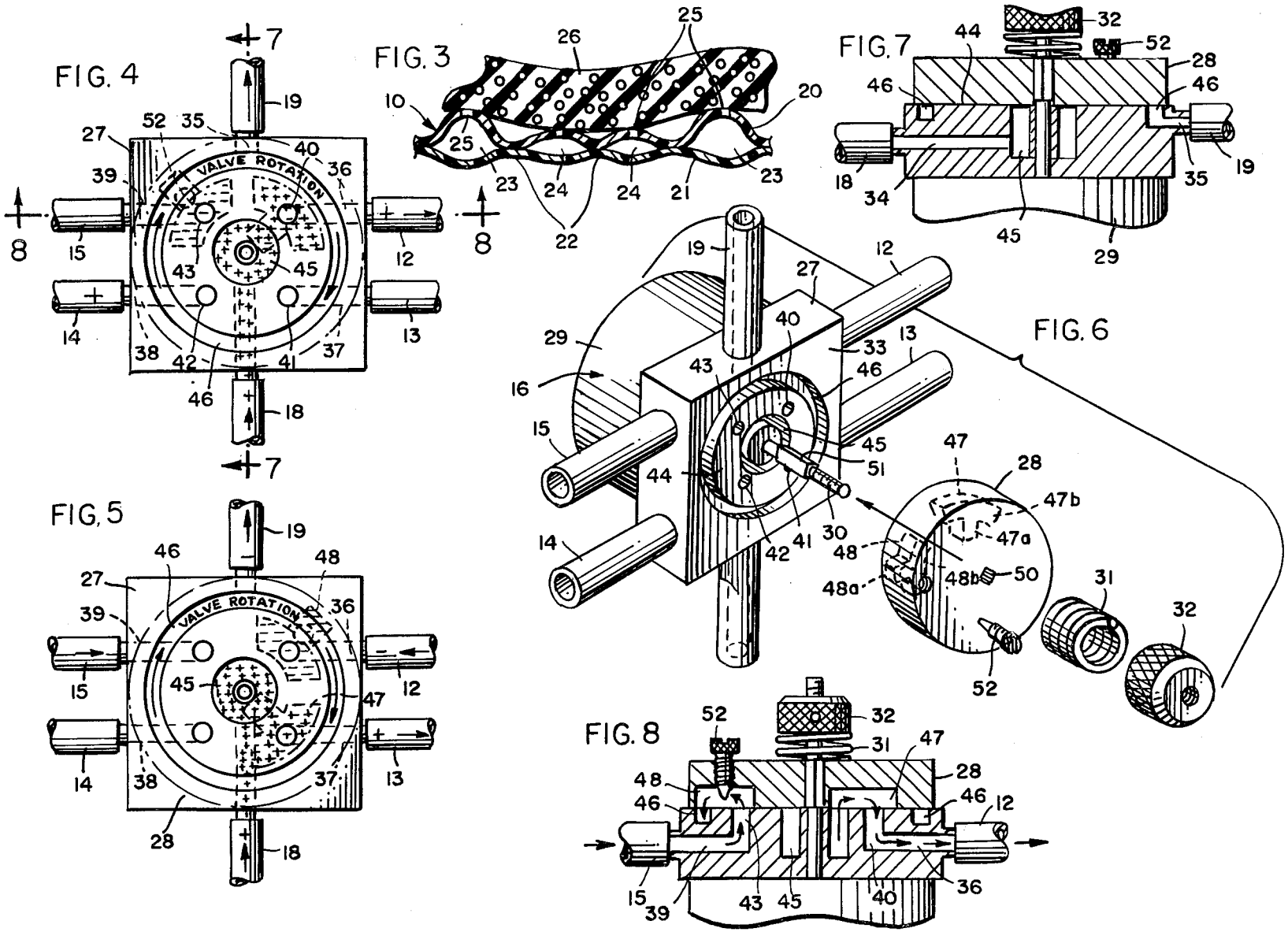
FIG. 3 is an enlarged fragmentary view of the pad taken along line 3—3 of FIG. 1, a foam cushion being illustrated in phantom to indicate the full pad-cushion combination.
FIG. 4 is an enlarged view of the valve body with the rotary valve member depicted in phantom and in the position shown in FIG. 1.
FIG. 5 is an enlarged view of the valve body similar to FIG. 4 but showing the valve member in phantom in the position of FIG. 2.
FIG. 6 is an exploded perspective view illustrating the components of the valve assembly.
FIG. 7 is a sectional view taken along line 7—7 of FIG. 4 but showing the valve member and associated elements as well as the valve body.
FIG. 8 is a sectional view taken along line 8—8 of FIG. 4 but showing the rotary valve member and associated elements as well as the valve body.
Figure 9:
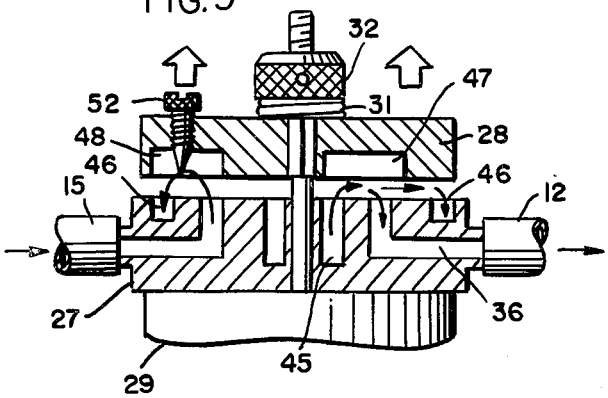
FIG. 9 is a sectional view similar to FIG. 8 but illustrating in somewhat exaggerated form the axial displacement of the valve member under increased pressure conditions.
Figure 11:
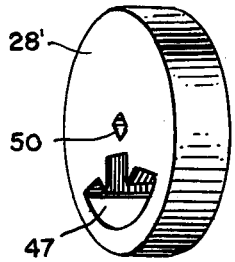
FIG. 11 is a perspective view of the rotary valve member used as a component of the control valve assembly (the remaining components being essentially as depicted in FIG. 6).
Figure 10:
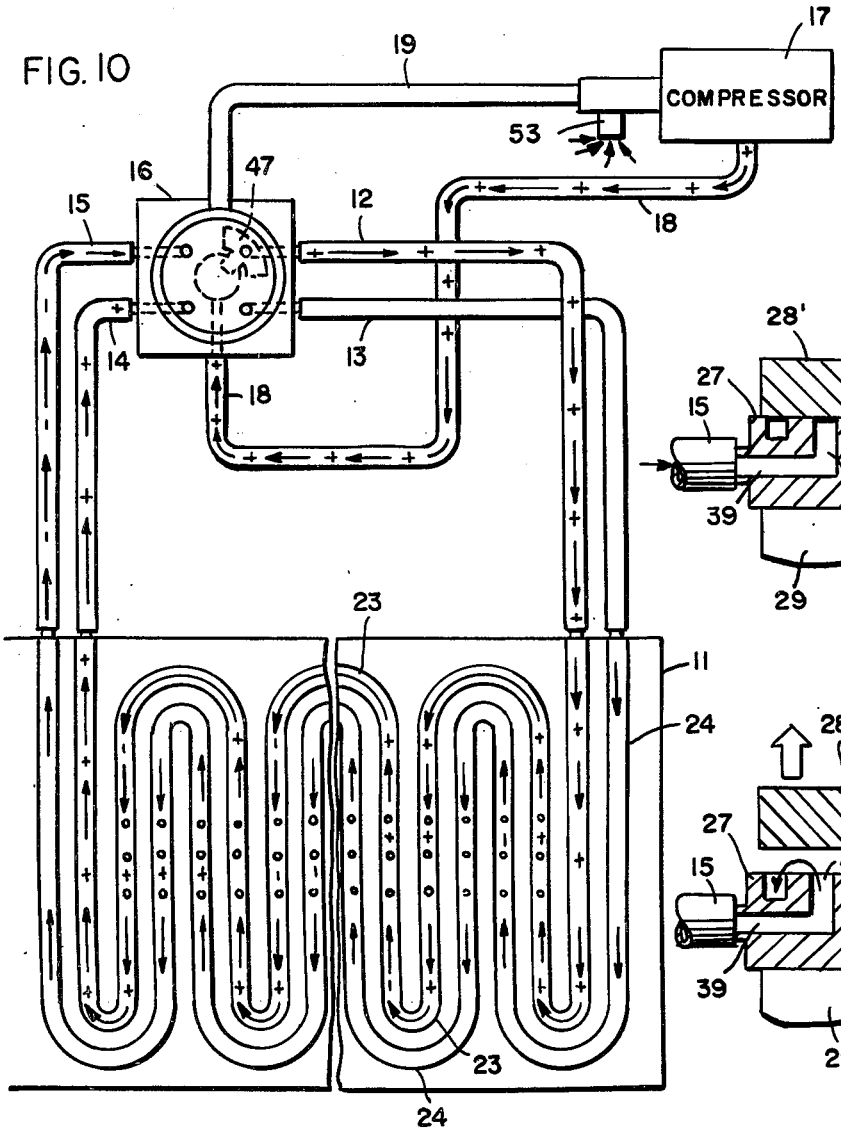
FIG. 10 is a somewhat schematic view of a system constituting a second embodiment of the invention.

The pad 11 is generally rectangular in configuration and, when used as a bed pan, would be dimensioned to be supported upon a standard bed mattress. The pad may advantageously be formed of a top wall or sheet 20 formed of a durable and flexible material and joined to a bottom wall or sheet 21 (which may also be of flexible material or, if desired, may be relatively rigid) by heat-sealing, sonic welding, adhesives, or any other suitable means, along portions 22 to define at least two interlaced serpentine passages 23 and 24 (FIG. 3). Natural or synthetic rubber may be used, as well as any of a variety of durable and flexible plastics, in fabricating the pad. As shown in FIGS. 1, 2, and 3, the top wall is provided with perforations 25 for the escape of air from the passages as will be described hereinafter. In use, the pad is covered with a porous cushion 26 formed of an open celled resilient plastic foam or any other suitable material. Since such a cusion or pad 26, and its use in conjunction with an inflatable pad, are well known in the art, as fully disclosed in U.S. Pat. No. 3,653,083, the further discussion of such a porous cushion is believed unnecessary herein.

In the embodiment illustrated, the interlaced passages 23 and 24 extend back and forth throughout substantially the full width and length of the elongated rectangular pad 11. Each inflatable passage starts at an opening at one end of the pad and terminates at an opening at the pad's opposite end; hence, air under pressure introduced at one end will produce an inflation of the passage starting at that end and traveling towards the opposite end of the pad until the entire passage is inflated. It is to be noted, however, that although each inflatable passage terminates adjacent opposite ends of the pad, portions of conduits 12–15 may be enclosed within or built into the pad so that appropriate connections between the pad and the control valve assembly need be made only at one end portion of the pad. Furthermore, although the passages are depicted as serpentine, the interlaced transverse portions may alternatively be of the general configuration illustrated in FIGS. 4–6 of aforementioned U.S. Pat. No. 3,653,083 except that, unlike the patented construction, each of such passages must effectively terminate at both ends of the pad.

Referring to FIG. 6, the control valve assembly 16 takes the form of a valve body 27, a rotary valve member 28, a motor 29 secured to the valve body and equipped with a shaft 30 for supporting and rotating the rotor, a compression spring 31, and an adjustment knob 32 threadedly carried by the end of drive shaft 30. The valve body 27 is shown as a generally rectangular block having a planar front face 33 against which the rotary valve member 28 is normally disposed. The block is bored in directions parallel with the face 33 to form inlet and outlet passages or openings 34 and 35, respectively (FIG. 7) and also to provide lateral passages 36–39 which communicate with conduits 12–15, respectively (FIG. 4). Passages or bores 36–39 extend inwardly and are joined at their respective inner ends by axial openings 40–43, respectively. Openings 40–43 are circumferentially and uniformly spaced along an annular portion 44 of the face 33 (FIG. 6).

Conduits 12–15 may take the form of flexible tubes or hoses, or portions of an integrated four-passage tube or hose, extending between the control valve assembly and the inflatable pad 11. Similarly, conduits 18 and 19 may take the form of flexible tubes or hoses, either joined or separate, extending between the control valve assembly and the compressor.

Referring to FIG. 7, it will be seen that inlet passage 34 communicates with an annular chamber 45 which extends about the hub of the drive shaft and which is open at the face of the valve block within the confines of annular zone 44. The outer limits of the annular zone are defined by a groove or channel 46 which communicates with outlet 35 (FIG. 7). Thus, in the operation of the device, channel 46 communicates with the intake of compressor 17 and is therefore under negative pressure, whereas chamber 45 communicates with the discharge end of the compressor and is under positive pressure.

The rotary valve member 28 is provided along its inner face (i.e., the surface facing the valve body) with a pair of T-shaped recesses 47 and 48. The stem portion 48*a* of recess 48 projects radially outwardly and is in constant communication with channel 46 when the parts are assembled. The intersecting portion 48*b* is arcuate and successively communicates with openings 40–43 of the valve body as the valve member is rotated.

The stem portion 47*a* of recess 47 is in continuous flow communication with chamber 45, whereas the intersecting arcuate portion 47*b* also is in successive communication with openings 40–43 as the rotary valve member is rotated. Thus, when the valve member is in the position illustrated in FIGS. 1, 4, and 8, compressed air discharged from compressor 17 passes into the inlet 34 and chamber 45 of the valve body, and then into recess 47 of the rotary valve member where it is distributed to opening 40 and connecting conduit 12 leading to inflatable chamber 23. At the same time, at the opposite end of the pad 11, inflatable chamber 24 is in flow communication with the intake of the compressor 17 through conduit 15, rotor recess 48, and valve outlet conduit 19. Inflatable chamber of passage 24 is therefore evacuated from one end of the pad while chamber or passage 23 is inflated from the opposite end. The result is a clearly noticeable inflation-deflation wave or ripple which starts at one end of the pad and ends at the opposite end. Shortly thereafter, when the rotary valve member has advanced to the position illustrated in FIG. 2, the direction of flow is altered with inflatable chamber 23 being evacuated and chamber 24 being inflated. As the rotary valve member advances into its next position, chamber 23 will again be inflated and chamber 24 will once more be evacuated. It is to be observed that each of the inflatable chambers is alternately inflated from its opposite ends. Similarly, deflation of each chamber occurs alternately from opposite ends of that chamber. Thus, chamber 23 is first inflated from one end, then deflated, and then inflated from its opposite end. The same inflation-deflation pattern occurs with respect to chamber 24. The result is that an inflation wave develops at one end of the pad and advances to the opposite end of the pad, then a second wave again develops (in the other chamber) starting at the same beginning and working its way towards the opposite end of the pad. Thereafter, the direction of the waves is reversed, an inflation wave starting at the opposite end of the pad and migrating to the original end, followed by a second wave originating at the opposite end (in the other chamber) and advancing towards the original starting end. The whole cycle is then repeated. Since the waves propagate in different directions over a full operating cycle (i.e., for inflations and for deflations), it is believed that the periodical reversal of direction of flow contributes significantly in reducing pressure points and in providing an improved system which enhances patient comfort and effectively reduces problems of decubitus ulcers for bedridden patients. It is also believed important that the discharge of air through perforations 25 of the pad, which provides ventilating and drying air for the patient to offset skin maceration and increase patient comfort, occurs more uniformly than in prior systems because of the reversing direction of inflation and wave propagation.

Referring to FIG. 8, channel 46 collects air returning from the deflating chamber through conduit 15, passage 39, opening 43, and recess 48 and, as revealed by FIG. 7, the air passing into channel 46 then flows to the compressor through passage 35 and conduit 19. In some cases, however, channel 46 may perform an additional function of collecting excess air and directing such excess air back to the intake of the compressor. In such a case, the control valve assembly serves as a regulator to limit the maximum inflation pressure of the inflatable chambers 23 and 24. The pressure-limiting operation of the valve assembly is indicated in FIG. 8 and, in particular, in FIG. 9.

Referring to FIG. 8, which depicts a normal operating condition, air under pressure enters the chamber 45 in the body of the valve and is directed to the pad through recess 47, opening 40, passage 36, and conduit 12. As the chamber 23 or 24 of the pad becomes fully inflated, a back pressure develops and, if that pressure reaches a predetermined level while the compressor continues to force air into the same chamber, the increased pressure within the valve assembly will cause the rotary valve member to become displaced axially away from the valve body, thereby allowing some of the air from the compressor to bypass opening 40 and enter channel 46 (FIG. 9) since the channel serves as an intake for the compressor, excess air is thereby returned directly to the compressor for recirculation. As soon as the rotary valve member has advanced to the point where recess 47 no longer overlies opening 40, the compression spring 31 returns the valve member into surface contact with the valve body. Adjustment of spring tension to control the maximum inflation pressure of the pad may be achieved by turning the knurled knob 32 one way or the other along the threaded end of shaft 30. It will be observed that the rotary valve member has an axial bore 50 of non-circular (square) cross section which slidably receives the non-circular (square) portion 51 of the drive shaft 30. The valve member is therefore mounted for limited axial movement while being locked against rotation independently of the shaft.

In the embodiment of FIGS. 1 ∝ 9, the valve assembly also includes flow restricting means in the form of a needle valve 52 positioned to control flow of air evacuated from the pad by the compressor. Ideally, the needle valve 52 is located in the rotor to partially obstruct the stem portion 48*a* of recess 48, the valve member being threadedly mounted and equipped with a slotted and knurled head portion 52*a* for selective adjustment of valve operation. By adjusting the valve member to provide greater restriction of flow, a smaller proportion of the air supplied to the compressor 17 is drawn from the inflatable chambers of the pad and a larger proportion takes the form of room air drawn through a separate compressor intake 53. As a result, evacuation of each chamber will occur more slowly. If the rotor indexes into its next position before evacuation of a given chamber is completed, then obviously some residual air will remain in that chamber. The differences in the heights in the inflated and relaxed chambers may therefore be controlled to achieve optimum effects.

While the needle valve member 52 is shown to be mounted in rotor 28 so that it protrudes into recess 48, it is believed apparent that the flow restricting means might be located elsewhere to achieve similar, although perhaps less effective, results. Thus, a flow restricting valve may be located in conduit 19 (FIG. 7), just downstream from the illustrated position, or in compressor intake 53 since by regulating the proportion of room air drawn into the compressor through the intake 53 the proportion of air evacuated from the pad is necessarily affected. Other valve locations may be selected; however, the location depicted in the drawings is believed particularly effective because in that location the flow restrictor affects only the air withdrawn from the chamber of the pad undergoing evacuation. The operation of the negative pressure groove 46 in collecting excess air in the manner already described is not affected.

In the embodiment of FIGS. 10–13, the only structural difference is found in the construction of rotary valve member 28'. Since the other parts of the system are the same as in the preceding embodiment, the same numerals are used.

Figure 12:
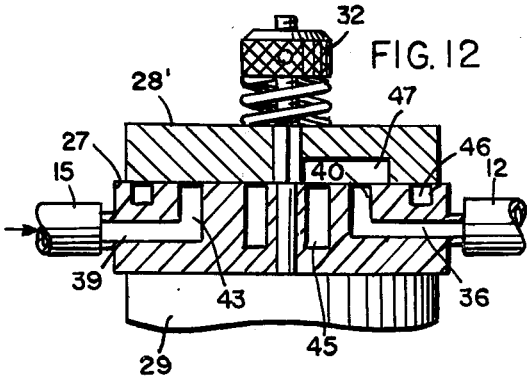
FIG. 12 is a sectional view showing the control valve assembly of the second embodiment in a normal operating condition.

Rotary valve member 28' is similar to member 28 except that it has only a single T-shaped recess 47. Recess 48 is omitted in valve member 28'. Since there is no positive evacuation of air from the chambers of the pad when the valve member is positioned as shown in FIG. 12, deflation of those chambers occurs primarily by reason of the escape of air through the perforations in the pad's upper wall.

Figure 13:
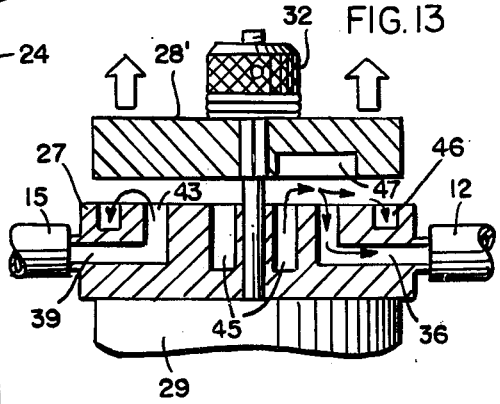
FIG. 13 is a sectional view similar to FIG. 12 but showing in exaggerated form the axial displacement of the rotary valve member under conditions of increased pressure.

As in the prior embodiment, the intake of compressor 17 is connected to the valve body by means of conduit 19. Although there is no positive evacuation of the chambers of the pad when the valve member is seated as shown in FIG. 12, the compressor does draw air from channel 46 in the valve body, creating a negative pressure in that channel. Should the inflation pressure in a chamber of the pad exceed a preselected maximum pressure, causing axial separation of the rotary valve member 28' from valve body 27 in the manner previously described, then excess air is free to pass directly from chamber 45 into channel 46 and be returned to the compressor for recirculation (FIG. 13). When such separation occurs, the channel 46 is also placed in communication with opening 43 and, consequently, the valve and compressor produce limited positive evacuation of the relaxed chamber as long as such separation exists. As before, spring 31 returns the valve member into its original position (FIG. 12) when the excess pressure condition is relieved.

Spring 31 is disclosed in both forms of the invention for the purpose of maintaining the valve member and valve body in sliding engagement with each other and, preferably, to permit slight axial separation of the parts when a predetermined back pressure (i.e., the maximum desired inflation pressure of the chambers of the pad) develops. It is to be understood, however, that similar results may be achieved, although perhaps less effectively, even in the absence of spring 31, as long as air under pressure is capable of leaking outwardly between the opposing faces of the parts. The channel 46 will perform the function of collecting excess air and returning it to the compressor when sufficient back pressure develops so that only a portion of the air from the inlet chamber 45 enters the selected openings 40–43, the remaining portion flowing outwardly between the opposing faces of valve body 27 and valve member 28 (or 28').

It is to be understood that in both forms of the invention the compressor 17 draws only part of its air requirements from conduit 19. Additional air as needed is taken directly from the room through an additional compressor intake 53. Furthermore, it is to be understood that in some installations the return conduit may be entirely deleted, thereby eliminating the capability of the system to recirculate excess air, evacuated air, or both. In such a system, however, the valve assembly will nevertheless operate in conjunction with the pad to cause each inflatable passage or chamber of that pad to be inflated alternately from its opposite ends and from opposite ends of the pad as a whole.

While in the foregoing we have disclosed embodiments of the invention in considerable detail for purposes of illustration, it will be understood by those skilled in the art that many of these details may be varied without departing from the spirit and scope of the invention.

We claim:

1. An inflatable pad and air control system comprising a pad having top and bottom walls defining a first inflatable passage extending substantially the full width and length of said pad and having its ends disposed adjacent opposite ends of said pad, said pad also having a second inflatable passage extending substantially the full width and length of said pad and having its ends disposed adjacent opposite ends of said pad, said first and second passages being interlaced and said pad being provided with perforations in said top wall communicating with each of said passages for the upward escape of air therefrom when said passages are inflated, a source of air under pressure, control valve means connected to said source of air, said control valve means including a valve body having four openings therein and a valve member movable in relation to said body for successively directing air under pressure through each of said four openings, conduit means connecting the ends of said inflatable passages to the respective openings of said valve body, and power means for advancing said valve member to direct air under pressure through each of said openings and through said conduit means to said pad, whereby, as said valve member is advanced, each passage is inflated alternately from its opposite ends to produce inflation waves traveling in opposite directions relative to said pad.

2. The system of claim 1 in which said source of air under pressure comprises a motor-driven compressor having an air inlet and an air outlet, said air outlet being connected to said control valve means to supply air under pressure to said pad.

3. The system of claim 2 in which said air inlet of said compressor is also connected to said valve means to draw excess pressurized air therefrom for recirculation of the same.

4. The system of claim 2 in which said inlet of said compressor is also connected to said valve means for successively drawing air from each one of said inflatable passages while the other of said passages is being inflated.

5. The system of claim 4 in which there are flow restricting means for regulating the amount of air drawn from said inflatable passages by said compressor.

6. The system of claim 5 in which said flow restricting means comprises an adjustable flow restricting valve.

7. The system of claim 2 in which said valve member and valve body have opposing faces in mutual engagement, said valve member being mounted for rotation with respect to said body to cause relative sliding movement of said faces about an axis of rotation, said openings of said body being uniformly spaced along a line circumscribing said axis of rotation, said body also having an annular inlet chamber open at the face of said body for receiving pressurized air from said compressor and an annular channel formed in the face of said body, passage means connecting said channel to the inlet of said compressor, said valve having a recess in the face thereof for successively interconnecting each of said openings with said inlet chamber as said valve member rotates relative to said body.

8. The system of claim 7 in which said inlet chamber is disposed radially inwardly from said line of openings circumscribing said axis of rotation, and said channel is disposed radially outwardly from said line.

9. The system of claim 8 in which said movable valve member is mounted for limited axial movement away from said body in response to air pressure between said opposing faces exceeding a selected pressure level, and spring means for returning said valve member into engagement with said body when said air pressure between said opposing faces is reduced below said selected pressure level.

10. The system of claim 9 in which adjustment means is provided for adjusting the force exerted by said spring means against said valve member.

11. The system of claim 2 in which said valve member and valve body have opposing faces in mutual engagement and said valve member is mounted for rotation with respect to said body to cause sliding movement of said faces about an axis of rotation, said openings of said body being uniformly spaced along a line circumscribing said axis of rotation, said body also having an annular inlet chamber open at the face of said body and communicating with said compressor for receiving pressurized air therefrom, an annular channel formed in the face of said body, passage means connecting said channel to the inlet of said compressor, said valve member having a first recess in the face thereof for successively interconnecting each of said openings with said inlet chamber as said valve member rotates relative to said body, said valve member also having a second recess in the face thereof for successively interconnecting each of said openings with said annular channel as said valve member rotates relative to said body, said first and second recesses being spaced apart to communicate with different openings in said body as said valve member rotates.

12. The system of claim 11 in which said inlet chamber is disposed radially inwardly of said line of openings circumscribing said axis of rotation, and said channel is disposed radially outwardly of said line.

13. The system of claim 12 in which said movable valve member is mounted for limited axial movement away from said body in response to air pressure between said opposing faces beyond a selected pressure level, and spring means engaging said valve member for urging the same into engagement with said body when said air pressure between said opposing faces is below said selected pressure level.

14. The system of claim 13 in which adjustment means is provided for adjusting the force exerted by said spring means against said rotary valve member.

15. The system of claim 11 in which there is flow restricting means for regulating the amount of air drawn from said inflatable passages by said compressor.

16. The system of claim 15 in which said flow restricting means comprises an adjustable flow restricting valve.

17. A control valve assembly for use in successively inflating the plural passages of a pad with air under pressure from a compressor and for recirculating to such compressor air in excess of the amount required for passage inflation, comprising a valve body and a movable valve member having opposing faces disposed in continguous relation for relative sliding movement of said faces about an axis of rotation, at least four openings provided in the face of said valve body, said openings being spaced along a line circumscribing said axis of rotation, said body having an annular inlet chamber open at the face of said body and adapted to communicate with the outlet of a compressor for receiving pressurized air therefrom, said body also having an annular outlet chamber formed in said face of said body and adapted to communicate with the inlet of a compressor for withdrawal of air from said chamber by said compressor, said valve member having a recess in the face thereof for successively interconnecting each of said openings with said inlet chamber as said member rotates relative to said body, said openings being adapted to communicate with the passages of an inflatable pad, and driving means for rotating said valve member relative to said valve body, said valve member and valve body being disposed relative to each other to permit excess air from said compressor to flow from said inlet chamber between said faces when a predetermined pressure level is attained in the inflated passages of a pad, said outlet channel collecting said excess air for returning the same to the compressor.

18. The control valve assembly of claim 17 in which said inlet chamber is disposed radially inwardly from said line of openings circumscribing said axis of rotation and said channel is disposed radially outwardly from said line.

19. The control valve assembly of claim 18 in which said movable valve member is mounted for limited axial movement away from said body in response to air pressure between said opposing faces exceeding a selected pressure level, and spring means for returning said valve member into engagement with said body when said air pressure between said opposing faces is reduced below said selected pressure level.

20. The system of claim 19 in which adjustment means is provided for adjusting the force exerted by said spring means against said valve member.

21. The control valve assembly of claim 17 in which said valve member is also provided with a second recess in the face therefor for successively interconnecting each of said openings with said annular channel as said valve member rotates relative to said body, said second recess and the first-mentioned recess being spaced apart to communicate with different openings in said body as said valve member rotates.

22. The control valve assembly of claim 21 in which said valve member is provided with adjustable flowrestricting means for regulating the flow of air from said openings to said channel.

23. The control valve assembly of claim 22 in which said flow-restricting means comprises a needle valve threadedly mounted in said valve member and projecting into said second recess for restricting the flow of air through said second recess.

24. An inflatable pad and inflation fluid control system comprising a pad having top and bottom walls defining a first inflatable passage extending substantially the full width and length of said pad and having open ends disposed adjacent opposite ends of said pad, said pad also having a second inflatable passage extending substantially the full width and length of said pad and also having open ends disposed adjacent opposite ends of said pad, whereby, said passages have four open ends disposed in pairs adjacent opposite ends of said pad, separate conduit means connected to each of said open ends of said passages, control valve means operatively connected to said conduit means and including a valve body and a valve member movable relative to said body for directing fluid under pressure through said conduit means successively to each of said open ends of said passages, a source of fluid under pressure connected to said control valve means, and power means for moving said valve member to direct fluid under pressure through each of said open ends of said passages, whereby, as said valve member is moved, each passage is inflated alternately from its opposite ends to produce inflation waves traveling in opposite directions relative to said pad.

25. The system of claim 24 in which said first and second passages are interlaced and said pad is provided with perforations in said top wall communicating with each of said passages for the escape of fluid therefrom when said passages are inflated.

26. The system of claim 24 in which said fluid is air and said source of fluid under pressure comprises a motor-driven compressor having an air inlet and an air outlet, said air outlet being connected to said control valve means for supplying air under pressure to said pad.

27. The system of claim 26 in which said air inlet of said compressor is also connected to said valve means to draw excess pressurized air therefrom for recirculation of the same.

28. The system of claim 26 in which said inlet of said compressor is also connected to said valve means for successively drawing air from each one of said inflatable passages while the other of said passages is being inflated.

29. The system of claim 28 in which there are flow restricting means for regulating the amount of air drawn from said inflatable passages by said compressor.

30. The system of claim 29 in which said flow restricting means comprises an adjustable flow restricting valve.

31. An inflatable pad and air control system comprising a pad having top and bottom walls defining a first inflatable passage extending substantially the full width and length of said pad and having its ends disposed adjacent opposite ends of said pad, said pad also having a second inflatable passage extending substantially the full width and length of said pad and having its ends disposed adjacent opposite ends of said pad, said first and second passages being interlaced and said pad being provided with perforations in said top wall communicating with each of said passages for the upward escape of air therefrom when said passages are inflated, a source of air under pressure, control valve means connected to said source of air and providing for air flow openings, conduit means connecting the ends of said inflatable passages to the respective openings of said valve means, and means for operating said valve means to direct air under pressure successively through each of said openings and through said conduit means to said pad, whereby, as said control valve means operates, each passage is inflated alternately from its opposite ends to produce inflation waves traveling in opposite directions relative to said pad.

32. The system of claim 31 in which said source of air under pressure comprises a motor-driven compressor having an air inlet and an air outlet, said air outlet being connected to said control valve means to supply air under pressure to said pad.

33. The system of claim 32 in which said air inlet of said compressor is also connected to said control valve means to draw excess pressurized air therefrom for recirculation of the same.

34. The system of claim 32 in which said inlet of said compressor is also connected to said control valve means for successively drawing air from each of said inflatable passages while the other of said passages is being inflated.

35. The system of claim 34 in which there are flow restricting means for regulating the amount of air drawn from said inflatable passages by said compressor.

36. The system of claim 35 in which said flow restricting means comprises an adjustable flow restricting valve.

37. An inflatable pad and inflation fluid control system comprising a pad having top and bottom walls defining a first inflatable passage extending substantially the full width and length of said pad and having open ends disposed adjacent opposite ends of said pad, said pad also having a second inflatable passage extending substantially the full width and length of said pad and also having open ends disposed adjacent opposite ends of said pad, whereby, said passages have four open ends disposed in pairs adjacent opposite ends of said pad, separate conduit means connected to each of said open ends of said passages, control valve means operatively connected to said conduit means for directing fluid under pressure through said conduit means successively to each of said open ends of said passages, a source of fluid under pressure connected to said control valve means and means for operating said control valve means to direct fluid under pressure through each of said open ends of said passages, whereby, as said control valve means is operated, each passage is inflated alternately from its opposite ends to produce inflation waves traveling in opposite directions relative to said pad.

38. The system of claim 37 in which said first and second passages are interlaced and said pad is provided with perforations in said top wall communicating with each of said passages for the escape of fluid therefrom when said passages are inflated.

39. The system of claim 37 in which said fluid is air and said source of fluid under pressure comprises a motor-driven compressor having an air inlet and an air outlet, said air outlet being connected to said control valve means for supplying air under pressure to said pad.

40. The system of claim 39 in which said air inlet of said compressor is also connected to said control valve means to draw excess pressurized air therefrom for recirculation of the same.

41. The system of claim 39 in which said inlet of said compressor is also connected to said control valve means for successively drawing air from each one of said inflatable passages while the other of said passages is being inflated.

42. The system of claim 41 in which there are flow restricting means for regulating the amount of air drawn from said inflatable passages by said compressor.

* * * * *